United States Patent [19]

Cavanagh

[11] Patent Number: 4,993,926

[45] Date of Patent: Feb. 19, 1991

[54] FUEL PUMPING APPARATUS

[75] Inventor: Eric J. Cavanagh, Surbiton, England

[73] Assignee: Lucas Industries Public Limited Company, Birmingham, England

[21] Appl. No.: 473,097

[22] Filed: Jan. 31, 1990

Related U.S. Application Data

[63] Continuation of Ser. No. 162,571, Mar. 1, 1988, abandoned.

[30] Foreign Application Priority Data

Mar. 11, 1987 [GB] United Kingdom ..... 8705783

[51] Int. Cl.[5] ..... F04B 59/20

[52] U.S. Cl. ..... 417/490; 123/496

[58] Field of Search ..... 47/490, 494, 499; 123/496, 506, 504, 503

[56] References Cited

U.S. PATENT DOCUMENTS 4,593,668 6/1986 Yuzawa ..... 123/496

*Primary Examiner*—Leonard E. Smith

*Attorney, Agent, or Firm*—Dvorak and Traub

[57] ABSTRACT

A fuel pumping apparatus for supplying fuel to an internal combustion engine includes a pumping plunger mounted in a bore and movable inwardly by an engine driven cam to displace fuel through an outlet to an injection nozzle. The quantity of fuel supplied to the nozzle is controlled by a spill valve. The apparatus also includes a restricted flow path through which fuel can flow to reduce the initial rate of fuel delivery through the nozzle, the flow path including a valve formed by the plunger and the bore so that fuel can flow through the flow path only during the initial inward movement of the plunger.

3 Claims, 1 Drawing Sheet

FUEL PUMPING APPARATUS

This application is a continuation of application Ser. No. 162,571, filed Mar. 1, 1988, now abandoned.

This invention relates to a fuel pumping apparatus for supplying fuel to an internal combustion engine and of the kind comprising a plunger reciprocable within a bore, an outlet from one end of the bore for connection in use to an injection nozzle of an associated engine, an engine driven cam for imparting inward movement to the plunger to effect displacement of fuel from said one end of the bore and a spill valve operable to allow fuel displaced by the plunger to flow to a drain thereby to control the quantity of fuel delivered through the outlet.

Apparatus of the aforesaid kind is known in which the spill valve is electrically operated and is controlled by an electronic control system which allows for the adjustment of the timing and the quantity of fuel delivered to the associated engine.

It is well known that in a high speed compression ignition engine the initial delivery of fuel to the engine should be at a restricted rate followed by the main quantity of fuel at a substantially unrestricted rate. It has been proposed to provide delivery control devices in or adjacent the injection nozzle which devices include spring loaded piston elements and restrictors. The piston elements introduce inertia problems. Moreover, such devices are expensive to manufacture and are not always consistent in operation throughout their life. Furthermore, it is not easy to produce a number of such devices which have substantially identical characteristics for fitment to the injection nozzles of an engine.

The object of the present invention is to provide an apparatus of the kind specified in a simple and convenient form.

According to the invention a fuel pumping apparatus of the kind specified comprises a restricted flow path from said one end of the bore, and co-operating valving edges formed on said plunger and in the wall of the bore whereby said flow path is open during a predetermined initial portion of the plunger stroke during the inward movement of the plunger.

Figure 2:
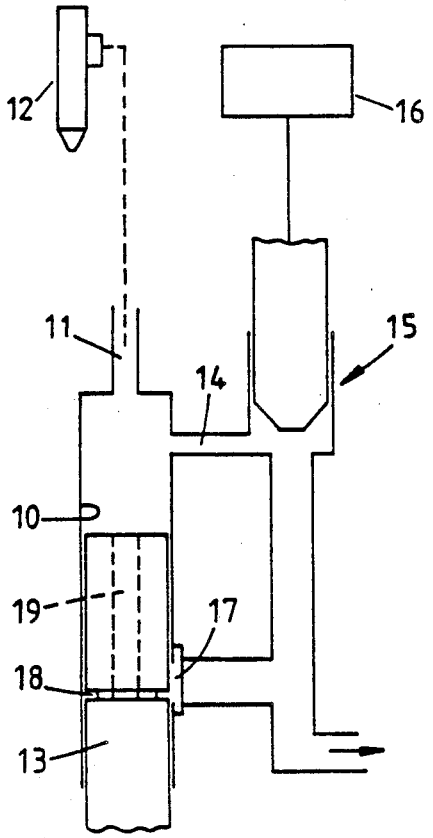
Figure 2:
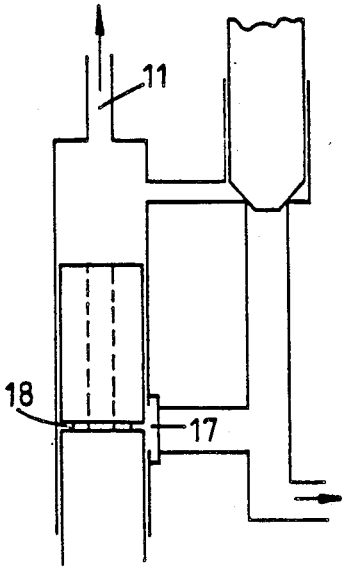
Figure 3:
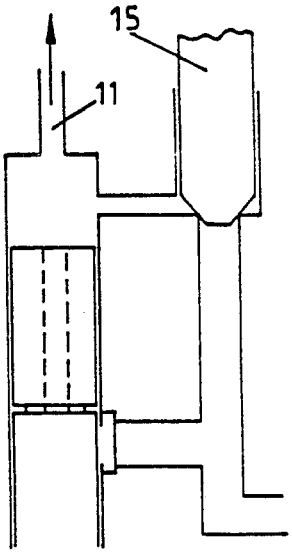
Figure 1:
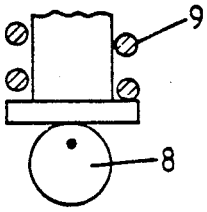
Figure 4:
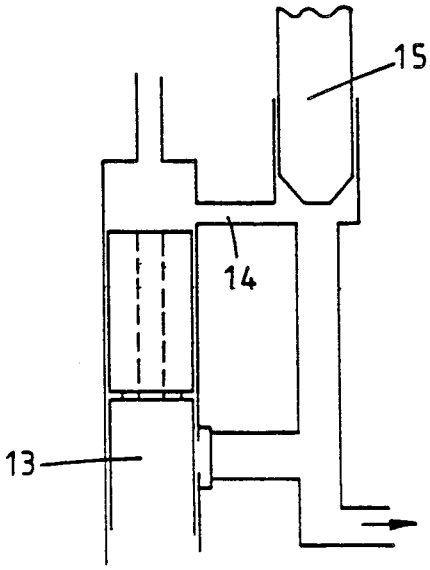
Figure 5:
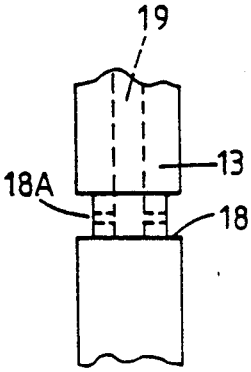

An example of a fuel pumping apparatus will now be described with reference to the accompanying drawings in which:

FIG. 1 is a diagrammatic illustration of the pumping apparatus and associated components, FIGS. 2, 3 and 4 show the apparatus of FIG. 1 with parts thereof at different settings, and FIG. 5 shows a part of the pump with the axial scale increased.

Referring to the drawings, the pumping apparatus comprises a bore 10 from which extends an outlet 11 which is connected in use, to a fuel injection nozzle 12 of an associated compression ignition engine. The outlet may be connected directly to a nozzle as shown or it may be connected through a distributor member to a plurality of injection nozzles which receive fuel in turn and in timed relationship with the associated engine. Conveniently the nozzle or nozzles are of the two stage lift type.

Slidable within the bore 10 is a plunger 13. The plunger is arranged to be moved inwardly towards the one end of the bore, by means of an engine driven cam 8 and it can be driven outwardly by means of a coiled compression spring 9 or by a further cam.

Extending from the one end of the bore is a spill passage 14 flow of fuel through which is controlled by a spill valve generally indicated at 15. The spill valve is controlled by an electromagnetic device 16 which in turn is controlled by an electronic control system responsive to various engine operating parameters and desired operating parameters. The passage 14 conveniently extends to a low pressure source of fuel not shown which may be a low pressure fuel supply pump.

Opening into the bore at a position spaced from the one end thereof is a recess 17 which also communicates with the aforesaid source of fuel. For co-operation with the recess 17, the plunger is provided with a narrow groove 18 which by way of an internal passage 19 in the plunger, communicates with the one end of the bore. The groove 18 is connected to the passage 19 by drillings 18A (FIG. 5) the flow area of which is comparable to the flow area of the outlet orifice or orifices of the nozzle 12. The drillings 18A form a restriction to the flow of fuel. The upper edge of the recess 17 and the lower edge of the groove 18 form valving edges.

Ignoring for the moment the effect of the restricted flow path formed by the drillings; during the inward movement of the plunger fuel will be displaced from the one end of the bore. If the valve 15 is open as shown in FIG. 1, the fuel will flow along the passage 14 back to the source of fuel. However, if the valve 15 is closed as shown in FIG. 3, the fuel will be displaced through the outlet 11 to the injection nozzle. If during the inward movement the valve 15 is opened as shown in FIG. 4, then the fuel will again flow along the passage 14 rather than through the outlet 11. The quantity of fuel delivered therefore depends upon the stroke of the plunger during the time when the valve 15 is closed and the timing of the delivery of fuel depends on the instant of closure of the valve 15.

Considering now the operation of the apparatus with the restricted flow path in operation. With the valve 15 opened as shown in FIG. 1, substantially all the fuel displaced during inward movement of the plunger will flow along the passage 14. However, if as shown in FIG. 2, the valve 15 is closed before the groove 18 has moved out of register with the recess 17, a restricted flow of fuel will take place through the groove 18 into the recess 17 and some fuel will flow through the outlet 11. The flow of fuel through the outlet 11 will be at a lower rate. With the spill valve 15 maintained in its closed position, as soon as the valving edge defined by the groove 18 moves beyond the valving edge defined by the recess 17 as seen in FIG. 3, the flow of fuel through the recess 17 will cease and the rate of flow of fuel through the outlet 11 will increase to its maximum value.

By the arrangement described it is possible to ensure that the initial flow of fuel to the associated engine is at a reduced rate and the duration of delivery at the reduced rate depends on the time in terms of degrees of engine crankshaft rotation, between the closure of the valve 15 and the closure of the groove 18 by the plunger.

As the engine speed is reduced, the requirement for a reduced initial rate of fuel delivery diminishes and the apparatus as described will automatically achieve this since with reducing engine speed the valve 15 will be closed later in the stroke of the pumping plunger so that the groove 18 will be covered very quickly after closure of the valve 15. In addition, because of the reduced engine speed, the pumping rate of the plunger will be reduced and it may not raise the pressure within the bore to a sufficient level with the groove 18 open to the recess, to enable the valve in the injection nozzle to be opened.

It will be understood that different quantities of fuel will be delivered at high and low engine speeds for equal periods of closure in terms of engine crankshaft degrees, of the spill valve. The control system 16 however can correct for this discrepancy by adjusting the closure time of the valve 15.

It will be further understood that the restriction to the flow of fuel which in the example described is provided by the drillings 18A connecting the groove 18 with the passage 19 may be in some other form. For example, the recess 17 can be replaced by a single port elongated in the circumferential direction so that the equivalent of a valving edge is formed. In this case the axial width of the groove 18 will have to be increased. Alternatively with a groove 18 of increased width the single port can be replaced by a plurality of smaller ports.

I claim:

1. A fuel pumping apparatus for supplying fuel to an internal combustion engine comprising:

a pumping plunger reciprocable within a bore;

an outlet from one end of the bore for connection in use to an injection nozzle of an associated engine;

an engine driven cam for imparting inward movement to the pumping plunger to effect displacement of fuel from said one end of the bore;

a spill valve operable to allow fuel displaced by the pumping plunger to flow to a drain thereby to control the quantity of fuel supplied by the apparatus;

a restricted flow path from said one end of the bore and cooperating valving edges formed on the pumping plunger and the wall of the bore;

said restricted flow path having a passage in said plunger, a circumferential groove in the plunger, and restricted drillings through which the passage is in communication with said groove;

said valving edges being defined by an end wall of said groove and by an end wall of a recess in said wall of said bore;

said groove being disposed with respect to said recess such that said groove is adjacent to and in communication with said recess during an initial period of the pumping plunger stroke, and is not adjacent to and is not in communication with said recess for the remainder of the pumping plunger stroke, whereby said flow path is open during a predetermined initial portion of the pumping plunger stroke during the inward movement of the pumping plunger and is closed for the remaining portion of the stroke.

2. An apparatus according to claim 1, wherein said passage in said plunger is a longitudinal bore.

3. An apparatus according to claim 1, wherein said spill valve is an electro-magnetic device.

* * * * *